US008821690B2

(12) United States Patent
Oksanen et al.

(10) Patent No.: US 8,821,690 B2
(45) **Date of Patent: *Sep. 2, 2014**

(54) PAPER PRODUCT, AND PROCESS FOR MANUFACTURING A PAPER PRODUCT

(75) Inventors: Mikko Oksanen, Lappeenranta (FI); Janne Varvemaa, Lappeenranta (FI)

(73) Assignee: UPM-Kymmene Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 13/394,192

(22) PCT Filed: Sep. 6, 2010

(86) PCT No.: PCT/FI2010/050687

§ 371 (c)(1), (2), (4) Date: Mar. 5, 2012

(87) PCT Pub. No.: WO2011/029995

PCT Pub. Date: Mar. 17, 2011

(65) Prior Publication Data

US 2012/0160441 A1 Jun. 28, 2012

(30) Foreign Application Priority Data

Sep. 9, 2009 (FI) ..... 20095930

(51) Int. Cl.
*D21F 2/00* (2006.01)

(52) U.S. Cl.
USPC ..... 162/204

(58) Field of Classification Search
USPC ..... 162/204, 100, 164.1; 428/212
See application file for complete search history.

(56) References Cited

U.S. PATENT DOCUMENTS

| | | | | |
|---|---|---|---|---|
| 6,551,454 | B1 | 4/2003 | Ewens et al. | |
| 7,435,473 | B2 * | 10/2008 | Anttila et al. | 428/212 |
| 8,277,611 | B2 * | 10/2012 | Sinkko et al. | 162/164.1 |
| 2004/0265542 | A1 * | 12/2004 | Yanagisawa et al. | 428/143 |
| 2005/0191469 | A1 * | 9/2005 | Anttila et al. | 428/195.1 |

FOREIGN PATENT DOCUMENTS

| | | | |
|---|---|---|---|
| EP | 1 489 230 | A1 | 12/2004 |
| EP | 1 493 866 | A1 | 1/2005 |
| EP | 1 659 219 | A1 | 5/2006 |
| EP | 1 762 656 | A2 | 3/2007 |
| JP | 2009-121011 | A | 6/2009 |
| WO | WO 2004/003293 | A1 | 1/2004 |
| WO | WO 2005/053958 | A1 | 6/2005 |
| WO | WO 2005/110753 | A1 | 11/2005 |
| WO | WO 2008/132182 | A2 | 11/2008 |
| WO | WO 2008/132283 | A1 | 11/2008 |
| WO | WO 2008/132284 | A1 | 11/2008 |

OTHER PUBLICATIONS

Smook, Gary, Handbook for Pulp and Paper Technologies, Chapter 17, 2001.*

International Search Report for corresponding International Patent Application PCT/FI2010/050687 mailed Jan. 28, 2011.

Finnish Search Report for corresponding Finnish Patent Application 20095930 mailed May 6, 2010.

Kano, T. "A Comparison between Oken Air Resistance-Smoothness Tester and Related Testers in Relations to Measured Values", Japan TAPPI Journal, vol. 62, No. 12, Dec. 2008, pp. 1570-1577.

Suvarnakich, K. et al. "Relationships between macroscopic paper structure and water absorption behavior", Japan Tappi Journal, vol. 62, No. 3, 2008, pp. 322-3332.

Chinese Office Action for corresponding Chinese Patent Application No. 201080039983.X mailed Jul. 16, 2013.

Supplementary European Search Report for corresponding European Patent Application No. 10815040 mailed Apr. 3, 2014.

* cited by examiner

*Primary Examiner* — Mark Halpern
(74) *Attorney, Agent, or Firm* — Merchant & Gould P.C.

(57) ABSTRACT

The invention relates to a paper product formed from fiber-based source material and applicable as printing paper. According to the invention, the surface of the paper product is finished by providing sufficient density on the surface so that the density of at least one surface layer of the paper product is sufficiently high to yield a Gurley-Hill value of more than 7000 s/100 ml as measured from the entire paper product, and the paper product has been dried to a moisture content of less than 3.5%. In addition, the invention relates to a process for manufacturing a paper product.

16 Claims, No Drawings

PAPER PRODUCT, AND PROCESS FOR MANUFACTURING A PAPER PRODUCT

This application is a National Stage Application of PCT/FI2010/050687, filed 6 Sep. 2010, which claims benefit of Serial No. 20095930, filed 9 Sep. 2009 in Finland and which applications are incorporated herein by reference. To the extent appropriate, a claim of priority is made to each of the above disclosed applications.

FIELD OF THE INVENTION

The invention relates to the paper product defined in the preamble of claim 1 and to the process for manufacturing a paper product defined in the preamble of claim 8, wherein a paper product applicable as printing paper is formed from a fiber-based raw material.

BACKGROUND OF THE INVENTION

Known from the prior art are different kinds of printing papers for use in printing and the manufacture of different kinds of printing papers for printing applications.

In the art of printing, different methods for the printing of paper are known, e.g. the offset or gravure techniques. In the known methods, especially in HSWO printing, inks are dried at high temperatures, typically at 120 to 150° C., which brings about a high moisture gradient between the printed and non-printed areas during drying of the ink. The high moisture gradient thus formed gives rise to an important factor that weakens the quality of the HSWO print, namely waving. It is known that attempts have been made to reduce waving by multiple means.

Known from the prior art is the drying of paper to a low moisture content before printing to reduce waving during printing. Known from publication WO 2005053958 is the pre-drying of paper in connection with a printing process. Known from publication WO 2005110753 is the drying of paper to a moisture content of less than 5% before printing. In addition, known from publication U.S. Pat. No. 6,551,454 is the drying of paper before printing to a moisture level of 0 to 4%. It has been discovered that a very low moisture content in paper, e.g. 1 to 1.5%, reduces waving in the printing Problems in drying the paper, e.g. in paper mill conditions, to a very low moisture content, such as 1 to 1.5%, include the reduction of cost-effectiveness and difficulties in treating the dry paper. A dry paper absorbs moisture quickly, and the moisture content of the paper returns quickly back to the equilibrium moisture content. Besides, winding of dry paper is difficult.

In addition, known from the prior art are so-called dense papers, e.g. from publication WO 2004003293, wherein the paper has an oleophilic surface an a Gurley-Hill value of more than 5000 s/100 ml, and from patent application PCT/FI2008/050229, wherein the paper has a Gurley-Hill value of more than 7000 s/100 ml. In addition, publication WO 2004003293 discloses a moisture level of 5.3 or 5.5% in paper. A problem in printing a dense paper is the blistering of the paper surface by the effect of the drying heat in an HSWO process.

OBJECTIVE OF THE INVENTION

An objective of the invention is to disclose a new type of a paper product for use as printing paper in printing. Especially, an objective of the invention is to disclose a paper product which allows the reduction of waving e.g. in HSWO printing.

In addition, an objective of the invention is to disclose a new process for manufacturing a paper product.

SUMMARY OF THE INVENTION

The paper product and the process according to the invention are characterized by what has been presented in the claims.

The invention is based on a paper product formed from a fiber-based source material and applicable as printing paper. According to the invention, the surface of the paper product is finished by providing a sufficient density on the surface, so as to have a density on at least one surface layer of the paper product which is sufficiently high to yield a Gurley-Hill value of more than 7000 s/100 ml as measured from the entire paper product, and the paper product is dried to a moisture content of less than 3.5%.

In addition, the invention is based on a process for manufacturing a paper product, wherein paper applicable as printing paper is formed from a fiber-based source material. According to the invention, the surface of the paper is finished to provide sufficient density on the surface, so as to have a density on at least one surface layer of the paper product being formed which is sufficiently high to yield a Gurley-Hill value of more than 7000 s/100 ml as measured from the entire paper product, and the paper is dried to a moisture content of less than 3.5% to form the paper product.

The invention is specifically based on a paper product, wherein at least one surface layer is arranged to be dense and which has a low moisture content. In the present invention, it has been surprisingly discovered that a combination wherein the surface of the paper product is finished by providing a sufficient density on the surface, so that the density of at least one surface layer of the paper product is sufficiently high to yield a Gurley-Hill value of more than 7000 s/100 ml as measured from the entire paper product, and wherein the paper product is dried substantially before printing to a moisture content of less than 3.5%, brings surprising advantages to the printing of the paper product. In tests, it was surprisingly discovered that the surface of the paper product according to the combination of the invention does not blister substantially by the effect of the drying heat in an HSWO process during printing, and the waving which impairs the print is reduced. In the paper according to the invention, the moisture gradient, i.e. drying gradient, between the printed and the non-printed surface can be decreased and waving can be reduced e.g. in HSWO printing.

In this connection, a paper product stands for any fiber-based paper, board or fiber product or the like. The paper product may have been formed from any fiber-based pulp, such as chemical pulp, mechanical pulp, chemimechanical pulp, fiber pulp, recycled pulp and their mixtures and/or equivalent. The paper product may be in the form of a wet web, dry web or sheet or in other form suitable for the purpose of use.

In one embodiment, fillers, pigments, bonding agents and/or other chemicals are added to the fiber-based source material in the manufacture of the paper product. Any agents and chemicals known in the art may be used as the fillers, pigments, bonding agents and chemicals.

In the manufacture of the paper product according to the invention, the so-called base paper used may be a suitable fiber-based, wood-containing and/or wood-free base paper which can be formed according to the invention into the paper product that is applicable as printing paper, such as LWC (Light Weight Coated), MWC (Medium Weight Coated), MFC (Machine Finished Coated), WFC paper (Wood Free Coated) or similar paper.

In this connection, a surface layer of the paper product or paper stands for a surface layer on the surface, e.g. a coating layer, that may have been formed by any finishing process known per se, for example by film coating, blade coating, curtain coating, spray coating or their combinations. There may be one or at least two surface layers on the surface of the paper product. In the alternative with more than one surface layer, a surface layer may stand for the topmost surface layer and/or any other surface layer under the topmost layer.

The Gurley-Hill process (ISO 5636-5:2003) comprises measuring, e.g. in seconds, the time consumed during printing through paper a specific air volume, e.g. 100 ml. The pressure difference is 1.21 kPa.

In one embodiment of the invention, the density of at least one surface layer of the paper product is sufficiently high to yield a Gurley-Hill value of more than 10000 s/100 ml as determined by the Gurley-Hill process and measured from the entire paper product. In one embodiment, the density of the paper product is more than 12000 s/100 ml as determined by the Gurley-Hill process.

In one embodiment of the invention, the paper product is dried to a moisture content of less than 3.0%. In one embodiment, the paper product is dried to a moisture content of less than 2.0%. In one embodiment, the paper is dried to a moisture content of less than 2.5% to form the paper product. In one embodiment, the paper is dried to a moisture content of less than 1.5% to form the paper product. In one embodiment, the paper is dried to a moisture content of more than 1.0% to form the paper product.

In one embodiment, the paper product is finished by a single-layer treatment.

In one embodiment, the paper product is finished by a multilayer treatment in which more than one surface layer is formed on the surface of the paper. The paper product may be double coated or it may be coated multiple times. In paper products that are coated multiple times and in double coated paper products it is sufficient that at least one of the surface layers is made dense in the manner defined by the invention. Alternatively, more than one surface layer is made dense in the manner defined by the invention.

In one embodiment of the invention, more than one surface layer in the paper product is arranged to be dense.

In one embodiment of the invention, the paper is finished by coating and/or surface-sizing to form the paper product. In one embodiment, the paper is finished with one layer. In one embodiment, the paper is finished with a multilayer treatment. In one embodiment, the paper is finished with a preliminary treatment to provide density in at least one surface layer. In a preferred embodiment, at least one other coating layer that may or may not be dense in the manner according to the invention is provided onto the dense preliminary treatment layer.

In one embodiment, a mixture containing at least one pigment and/or at least one bonding agent is provided on the surface of the paper in order to form at least one surface layer. In one embodiment, the mixture contains at least one pigment and at least one bonding agent.

In one embodiment of the invention, the pigment is selected from the group of: kaolines, talcs, calcium carbonates, gypsum, titanium dioxides and their mixtures and suchlike pigments. Any pigment known per se in the art and suitable for the purpose of use may be used as the pigment.

In one embodiment of the invention, the bonding agent is selected from the group of: starches, proteins, latexes, carboxy-methyl cellulose, polyvinyl alcohol and their mixtures and the like. Any bonding agent known per se in the art and suitable for the purpose of use may be used as the bonding agent.

The mixture to be provided on the surface of the paper may be any finishing composition, e.g. a coating agent mixture or a surface-size composition.

Any suitable bonding agents and pigments can be used in the finishing of the paper. Furthermore, suitable additives known per se in the art can be added to the finishing mixture.

In the paper product, the densifying surface layer may be any surface layer. In one embodiment, the densifying layer is the preliminary coating layer. In one embodiment, the densifying layer is the topmost surface layer. In one embodiment, the densifying layer is one of the interlayers. In one embodiment, the topmost surface layer is not the densifying layer, in which case the desired properties, e.g. in terms of printability, may be provided on the topmost surface layer.

In one embodiment, the coat weight of one surface layer, preferably the densifying layer, is 1 to 14 g/m$^2$/side, more preferably 6 to 14 g/m$^2$/side. In one embodiment, the total coat weight is 7 to 40 g/m$^2$/side.

In one embodiment, the density of the paper may be provided in the manner presented in publications WO 2008132283 and WO 2008132284.

In one embodiment of the invention, the paper is dried substantially before printing to form the paper product. In one embodiment, the paper is dried during the papermaking process. In one embodiment, the paper is dried in connection with finishing, e.g. coating. The drying may be performed by a separate drier or in connection with the papermaking drier section, drying of the coating and/or calendering. In one alternative embodiment, the paper is dried in connection with the printing process, e.g. by a press. In one embodiment, the drying following the printing may be performed at lower temperatures than conventionally.

In one embodiment of the invention, the paper is calendered, preferably after the finishing, to form the paper product.

In one embodiment of the invention, the paper can be used as printing paper in Offset printing, specifically HSWO printing.

The manufacture, coating, surface-sizing, drying, calendering and/or printing etc. of the paper may be performed in manners known per se in the art.

The paper product and the process according to the invention provide considerable advantages as compared to the prior art.

Thanks to the paper product according to the invention, a high-quality printed product and reduction of waving in printed paper are provided. In addition, thanks to the invention, it is possible to reduce the fiber roughness, increase the gloss level and reduce the risk of blistering on the surface of the paper product.

The invention provides a simple and cost-effective way of manufacturing industrially a high-quality paper product that is applicable as printing paper. In the printing, it is possible to use inexpensive commercial inks known per se without the risk of waving, which reduces the printing costs. Thanks to the invention, the drying of the paper product after printing may be reduced.

DETAILED DESCRIPTION OF THE INVENTION

In the following section, the invention will be described with the aid of detailed examples of its embodiments.

Example 1

In this pilot example, LWC-type paper having a grammage of about 65 gsm and being applicable as printing paper was formed of mechanical pulp known per se. The wood-containing base paper was lightly single coated with a pigment/bonding agent mixture, the coat weight being 11 g/m$^2$/side. Kaoline was used as the pigment. Alternatively, any pigment known per se can be used as the pigment. The bonding agent used was SB latex.

The principal components used in the coating slip were 100 parts kaoline and 14 parts bonding agent. The particle size distribution in the kaoline used was such that the portion of the particles of less than 2 μm was 85-95% as measured by Sedigraph 5100. Furthermore, the coating slips contained approximately 3.3 parts additives known per se. The solids content in the coating slips was 61 w-%.

After coating, the paper was supercalendered to a gloss level of 65%.

The density of the outturn sheet according to the invention was measured as 14370 s/100 ml.

The reference paper used was a corresponding wood-containing LWC paper in which the coating slip comprised 60 parts Century kaoline, 40 parts Covercarb calcium carbonate and 12 parts DL966 latex. Furthermore, the coating slip contained 1.5 parts additives known per se. The wood-containing base paper was blade coated, the coat weight being 11 g/m$^2$/side. The coated paper was supercalendered to a gloss level of 65%. The density of the reference paper was measured as 1880 s/100 ml.

The paper according to the invention and the reference paper were both dried by a separate pilot drier just before printing. Thus, the pilot drying was performed after calendaring carried out at the paper mill. The pilot drier was composed of three infrared driers and four fluidized-bed driers. The drying was performed to the moisture of approximately 2% and to the moisture of approximately 1%. The initial moisture content at the paper mill was 5% in the paper according to the invention and 3.7% in the reference paper, which was surprisingly low due to the season.

The papers were printed by HSWO printing, using the Albert Frakenthal A 101 S printing machine. A commercial HSWO ink known per se was used in the printing. The exit temperature of the web was 130° C. after drying.

Table 1 presents the visual estimate of waving after HSWO printing.

TABLE 1

| Paper | Moisture before printing | Visual estimate of waving |
|---|---|---|
| Reference paper | 3.7% | strong waving |
| Reference paper | 2% | medium waving |
| Reference paper | 0.8% | relatively small degree of waiving |
| Paper according to the invention | 5% | waving not assessable due to blistering |
| Paper according to the invention | 2% | very small degree of waving |
| Paper according to the invention | 1.2% | no waving |

The results of Table 1 show that the reduction of moisture content allows the use of the paper according to the invention without the blistering problem. In the paper according to the invention, an important improvement in waving is achieved already with a moisture level of 2%, whereas waving as low as this is not reached with the reference paper even with the moisture of 0.8%.

Example 2

In this paper mill example, LWC-type paper having a grammage of about 65 gsm and being applicable as printing paper was formed from mechanical pulp known per se. The wood-containing base paper was lightly single coated with a pigment/bonding agent mixture, the coat weight being 11 g/m$^2$/side. Kaoline was used as the pigment. Alternatively, any pigment known per se can be used as the pigment. The bonding agent used was SB latex.

The principal components used in the coating slip were 100 parts kaoline and 14 parts bonding agent. The particle size distribution in the kaoline used was such that the portion of the particles of less than 2 μm was 85-95% as measured by a Sedigraph 5100. Furthermore, the coating slips contained approximately 3.3 parts additives known per se. The solids content in the coating slips was 61 w-%.

After coating, the paper was supercalendered to a gloss level of 65%.

The density of the outturn sheet according to the invention was measured as 7900 s/100 ml. In difference to Example 1, a separate pilot drier was not used, but the paper was dried in connection with coating to a greater dryness than normally, so that the end-point moisture content of the paper as formed after supercalendering was 3%.

The papers were printed by HSWO printing using a Heidelberg M600 press. Commercial HSWO printing ink known per se was used in the printing. The exit temperature of the web was 130° C. after drying.

After printing, considerable improvement in terms of waving was observed in the printing paper according to the invention during visual inspection when the printing paper according to the invention was compared with the reference paper of Example 1.

The manufacture, coating, calendering and printing of the paper were performed in manners known per se and are not described in any more detail in this context.

In all tests, the papers according to the invention proved to be good printing papers on the base of waving of the paper and evenness and sharpness of the impression. In addition, the papers according to the invention did not exhibit the blistering problem.

In summary, it can be concluded that the process according to the invention easily provides good-quality printing paper.

The paper product and the process according to the invention are applicable in different embodiments for use in the manufacture of most different kinds of printing paper products.

The invention is not limited merely to the examples referred to above; instead, many variations are possible within the scope of the inventive idea defined by the claims.

The invention claimed is:

1. A paper product formed from fiber-based source material and applicable as printing paper, wherein the surface of the paper product is finished by providing sufficient density on the surface so that the density of at least one surface layer of the paper product is sufficiently high to yield a Gurley-Hill value of more than 7000 s/100 ml as measured from the entire paper product, and the paper product has been dried to a moisture content of less than 3.0%.

2. The paper product according to claim 1, wherein the density of at least one surface layer of the paper product is sufficiently high to yield a Gurley-Hill value of more than 10000 s/100 ml as measured from the entire paper product.

3. The paper product according to claim 1, wherein the density of at least one surface layer of the paper product is sufficiently high to yield a Gurley-Hill value of more than 12000 s/100 ml as measured from the entire paper product.

4. The paper product according to claim 1, wherein the paper product is dried to a moisture content of less than 2.0%.

5. The paper product according to claim 1, wherein more than one surface layer is arranged to be dense.

6. The paper product according to claim 1, wherein the paper product is applicable as printing paper in HSWO printing.

7. The paper product according to claim 1, wherein the at least one surface layer of the paper product has a coat weight of about 6-14 g/m$^2$ per side.

8. A process for manufacturing a paper product, wherein paper that is applicable as printing paper is formed from fiber-based source material, wherein the surface of the paper is finished in order to provide sufficient density on the surface so that the density of at least one surface layer of the paper product being formed is sufficiently high to yield a Gurley-Hill value of more than 7000 s/100 ml as measured from the entire paper product, and the paper is dried to a moisture content of less than 3.0% to form the paper product.

9. The process according to claim 8, wherein the surface of the paper is finished by surface-sizing and/or coating.

10. The process according to claim 8, wherein more than one surface layer is arranged to be dense.

11. The process according to claim 8, wherein the density of at least one surface layer of the paper product is arranged to be sufficiently high to yield a Gurley-Hill value of more than 10000 s/100 ml as measured from the entire paper product.

12. The process according to claim 8, wherein the density of at least one surface layer of the paper product is arranged to be sufficiently high to yield a Gurley-Hill value of more than 12000 s/100 ml as measured from the entire paper product.

13. The process according claim 8, wherein the paper is dried to a moisture content of less than 2.0% to form the paper product.

14. The process according to claim 8, wherein the paper is dried substantially before printing.

15. The process according to claim 8, wherein the paper is calendered.

16. The process according to claim 8, wherein the at least one surface layer of the paper product has a coat weight of about 6-14 g/m$^2$ per side.

* * * * *